US006122783A

United States Patent [19]

Herndon et al.

[11] Patent Number: 6,122,783

[45] Date of Patent: Sep. 26, 2000

[54] REMOVABLY SECURABLE BED COVERING

[76] Inventors: Tyrone Herndon, 43 Holborn St., Roxbury, Mass. 02119; Mark Fortes, 64 Sanford St., Mattapan, Mass. 02126

[21] Appl. No.: 09/266,228

[22] Filed: Mar. 10, 1999

[51] Int. Cl.[7] ..... A47G 9/02; A47G 9/08

[52] U.S. Cl. ..... 5/496; 5/494; 5/413 R

[58] Field of Search ..... 5/496, 498, 494, 5/502, 413 R, 482

[56] References Cited

U.S. PATENT DOCUMENTS

| | | | |
|---|---|---|---|
| 2,789,292 | 4/1957 | Budinquest | 5/496 |
| 3,083,378 | 4/1963 | Pursell | 5/494 |
| 3,857,124 | 12/1974 | Hadley | 5/494 |
| 4,161,044 | 7/1979 | Bogle | 5/494 |
| 4,304,018 | 12/1981 | McClam | 5/494 |
| 4,339,835 | 7/1982 | Jaffe et al. | 5/498 |
| 4,402,098 | 9/1983 | McClam | 5/494 |
| 4,546,508 | 10/1985 | Ison | 5/494 |
| 5,003,655 | 4/1991 | Kafai | 5/496 |
| 5,046,207 | 9/1991 | Chamberlain | 5/497 |
| 5,099,531 | 3/1992 | Schmier | 5/496 |
| 5,416,938 | 5/1995 | Li | 5/494 |
| 5,566,411 | 10/1996 | Eiler | 5/494 |
| 5,572,754 | 11/1996 | Lazar et al. | 5/494 |
| 5,794,285 | 8/1998 | Burch . | |

FOREIGN PATENT DOCUMENTS

| | | | |
|---|---|---|---|
| 2241643 | 11/1991 | United Kingdom | 5/496 |

*Primary Examiner*—Alexander Grosz
*Attorney, Agent, or Firm*—Kudirka & Jobse, LLP

[57] ABSTRACT

A bedding apparatus includes a top cover for a mattress that is removably securable to a mattress band. The mattress band is, in turn, removably securable to the mattress without physical connection. The connections between the top cover and the mattress band may be zippers that allow them to be connected along three sides. The zipper portions on the mattress band and the top cover are complementary, allowing the two components to be zipped together. The two zipper portions on the top cover are also complementary with each other, allowing the top cover to be zipped together into a self-contained sleeping enclosure. The mattress band may encircle the mattress, and can be mounted over an underlying mattress covering, such as a sheet. When the top cover is secured to the mattress band, and there is no person located between the top cover and the mattress, the top cover drapes over the sides of the mattress to a vertical position lower than that of the securing connections between the top cover and the mattress. The top cover therefore has a portion folded under between the mattress and an outer portion of the top cover.

20 Claims, 8 Drawing Sheets

REMOVABLY SECURABLE BED COVERING

FIELD OF THE INVENTION

The invention relates generally to the field of bedding and, more particularly, to bedcovers that are securable to a bed in an easily removable manner.

BACKGROUND OF THE INVENTION

In the field of bedding, there has been recognition of the desire to have a bedcover that can be secured to a bed. Such a bedcover would be useful with regard to the needs of children and the elderly. With a loose bedcover, or even one that is simply tucked under the mattress, the cover may be pulled free from the bed. In such a case, a restless sleeper may accidentally knock off the cover.

In the past, bedding arrangements have been made that allow securing of a bedcover to a mattress. For example, some bedding arrangements have been constructed that consist of a single integral piece, in which a top covering portion is sewn, or otherwise permanently attached, to a lower, mattress-securing portion. An example of such a system is shown in U.S. Pat. No. 4,304,018 to McClam. The bedding arrangement described in this prior art patent has a side covering 36 that is held between a mattress 12 and box spring 14. The top covering 32 of McClam has enough extra material that, when zipper 46 is unzipped, there is room for occupants between the surface of the mattress and the top covering. This extra material folds into a pleat on top of the mattress when the bed is unoccupied and the zipper 46 is closed. While the zipper 46 is open, the top covering 32 is integral with the side covering 36 along three sides. The exception is at the position of either zipper 52, which allows a portion of the top covering near the head of the bed to be disconnected from the side covering to make it easier for a person to climb into the bed.

One piece bedding units, such as that of McClam, are functional, but are unwieldy and make cleaning more difficult. Furthermore, the securing of the bedding to the mattress relies on the elastic gathered corner portions 40, as well as the pressure between mattress and box spring. Thus, if the side covering were detached to from the top covering, it would fall down and hang from the space between the mattress and box spring. In fact, in such a case the side covering would remain connected to the bed only by the pressure contact between the mattress and box spring. If the mattress was not sitting atop a box spring, and was only supported in certain locations, the unsupported regions would not allow for securing of the side covering, and it would be loose in those regions.

SUMMARY OF THE INVENTION

In accordance with the present invention, a bedding apparatus is provided that includes a mattress band that is removably securable to a mattress along at least two opposite sides of the mattress. Removably securable to the mattress band is a top cover that connects to the mattress band with securing connections adjacent to the two opposite sides of the mattress. Preferably, these securing connections are zippers, although hook and pile cloth or some other connection means may be used.

When no person is lying between the mattress and the top cover, the vertical position of each securing connection is higher than that to which the top cover hangs. That is, the top cover drapes over each of the opposite sides of the mattress so that it hangs lower that the point at which it is connected to the mattress band. As such, a portion of the top cover is folded between an outer portion of the top cover and the mattress. Preferably, such a folded portion of the top cover exists to either side of the mattress. With the folded portion (or portions), the total length of the top cover between the securing connections is sufficient to allow a person to be accommodated in between the top cover and the mattress without any significant strain on the securing connections.

In the preferred embodiment, the top cover includes two zipper portions, each of which is part of one of the securing connections. One of the two zipper portions of the top cover is a male zipper portion, while the other is a female zipper portion. With this configuration, the top cover, when not on the mattress, can be used as a portable, self-contained sleeping enclosure. By zipping the male zipper portion of the top cover to the female portions of the top cover, a sleeping bag type enclosure is formed.

In the preferred embodiment, the top cover also includes a connector on each side of the top cover that is closer to an unsecured end of the top cover than the securing connections, that is, closer to the "head" portion of the mattress. The connector typically includes a connection portion on the mattress band and a connection portion on the top cover. For example, these portions may be male and female snap portions. One pair of such snap portions would reside on either side of the mattress, each pair including a portion on the top cover and a portion on the mattress band. Preferably, if the snap portion on one side of the top cover is a female snap portion, the snap portion on the other side of the top cover is a male snap portion. In this way, the two snap portions can be snapped together when the top cover is used as a self-contained sleeping enclosure, as described above.

The mattress band of the invention may be a closed loop that encircles the mattress when it is secured thereto. An elastic portion may be used to help keep the band secured to the mattress. Similarly, a drawstring may be used in place of, or in addition to, the elastic portion. Notably, however, the mattress band is securable to the mattress without physical connection, thereby allowing it to be secured to a standard, unmodified mattress. The mattress band may also be secured to the mattress over an underlying covering, such as a sheet, which is already in place on the mattress. Thus, use of the apparatus does not interfere with the use of standard sheets on the mattress.

DETAILED DESCRIPTION OF THE PREFERRED EMBODIMENT

Figure 1:
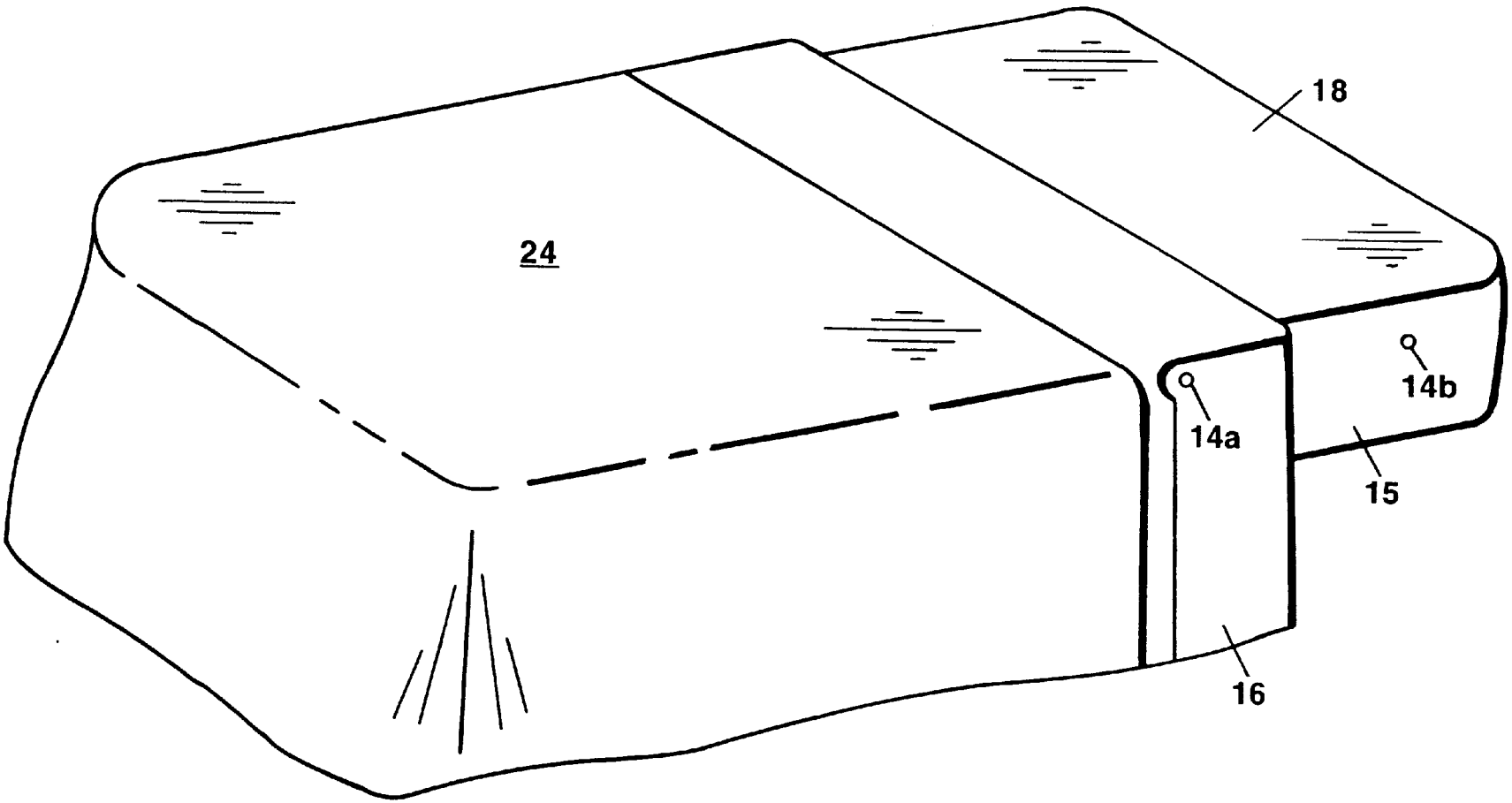
FIG. 1 is a perspective view of the present invention shown with a portion of the top cover near the head of the mattress folded back.

Shown in FIG. 1 is a standard bed mattress 18 on which is mounted a top cover 24 according to a preferred embodiment of the invention. Also located on the mattress 18 is a fitted mattress band 15 to which the top cover 24 may be removably attached. One portion of the top cover is referred to as the "underlying extension" 16, because it lies under the remainder of the top cover 24 when the top cover is attached to the mattress band 15. In FIG. 1, a portion of the top cover near the head of the mattress 18 is shown folded back, as is typical with conventional bedclothes. In the folded back position, the back side of a female snap connector 14*a* attached to the top cover 24 is exposed, as is the front side of a corresponding male snap connector 14*b* on the mattress band 15. It will be understood that, when this portion of the top cover is not folded back as shown, the two snaps 14*a,* 14*b* may be brought together and connected to each other. As will be described below, this is only part of the means by which the top cover 24 is secured to the mattress band 15.

Figure 2:
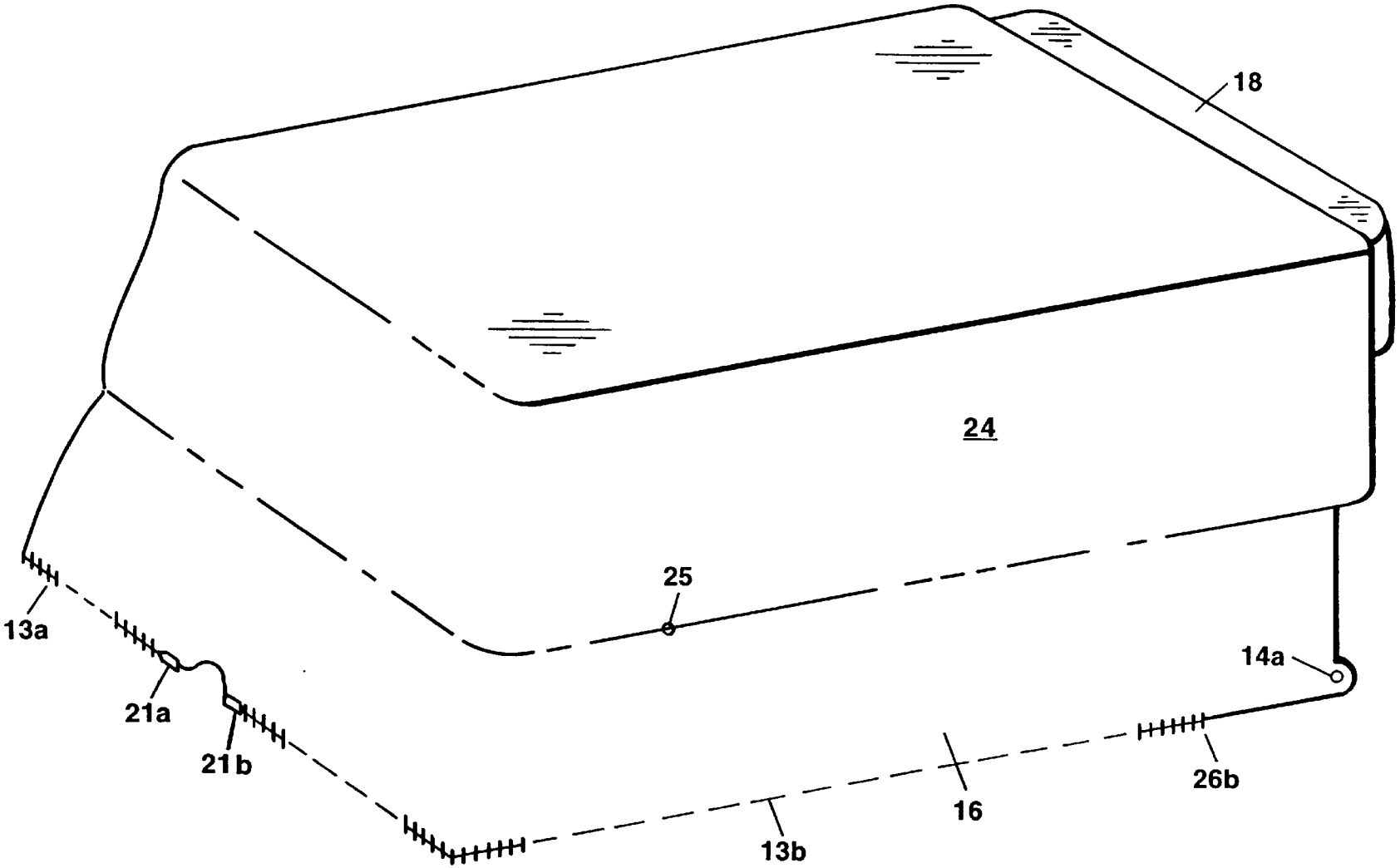
FIG. 2 is a perspective view of the invention shown with the top cover draped over the mattress, but not secured to the mattress band.

FIG. 2 depicts the top cover 24 and mattress 18 when the top cover is fully disconnected from the mattress band. In this position, the top cover 24 is merely draped over the mattress 18. At one corner of the top cover is shown the front side of snap 14*a.* Those skilled in the art will understand that a second set of snaps 14*a,* 14*b* exist on the top cover 24 and the mattress band 15 on the opposite side of the mattress, relative to an axis of symmetry passing through the center of the mattress from head to foot. However, on the opposite side of the mattress, the female snap portion 14*a* is on the mattress band, while the male snap portion 14*b* is on the top cover.

In the position of the top cover 24 shown in FIG. 2, the underlying extension 16 of the top cover is visible. Although the underlying extension is integral with the top cover, a crease 25 is shown in the figure to indicate a separating line between the top outer portion of the top cover 24 and the underlying extension 16. When the top cover is attached to the mattress band, as shown in FIG. 1, the underlying extension 16 is hidden from view, being shielded by the outer portion of the top cover 24. The top cover may be constructed of any conventional quilt or comforter material, such as cotton or polyester. However, the underlying extension may be of a thinner, non-filled material, so that it does not add any significant bulk between the mattress and the outer portion of the top cover.

FIG. 2 also shows two zipper portions attached to the underlying extension 16 of the top cover. A female zipper portion 13*a* is sewn along a first edge portion of the underlying extension 16, while a male zipper portion 13*b* is sewn along a second edge portion. The edge portion occupied by the male zipper portion 13*b* runs from male zipper start 21*b* to male zipper end 26*b.* Similarly, the edge portion occupied by the female zipper portion 13*a* runs from female zipper start 21*a* to the female zipper end (not shown). The female zipper runs the same distance along the first edge of the underlying extension 16 as the male zipper runs along the second edge. As will be discussed in more detail below, with these cooperating zipper portions allows the top cover 24 can be zipped to itself, when removed from the mattress, and can thereby function as a sleeping bag.

Figure 3:
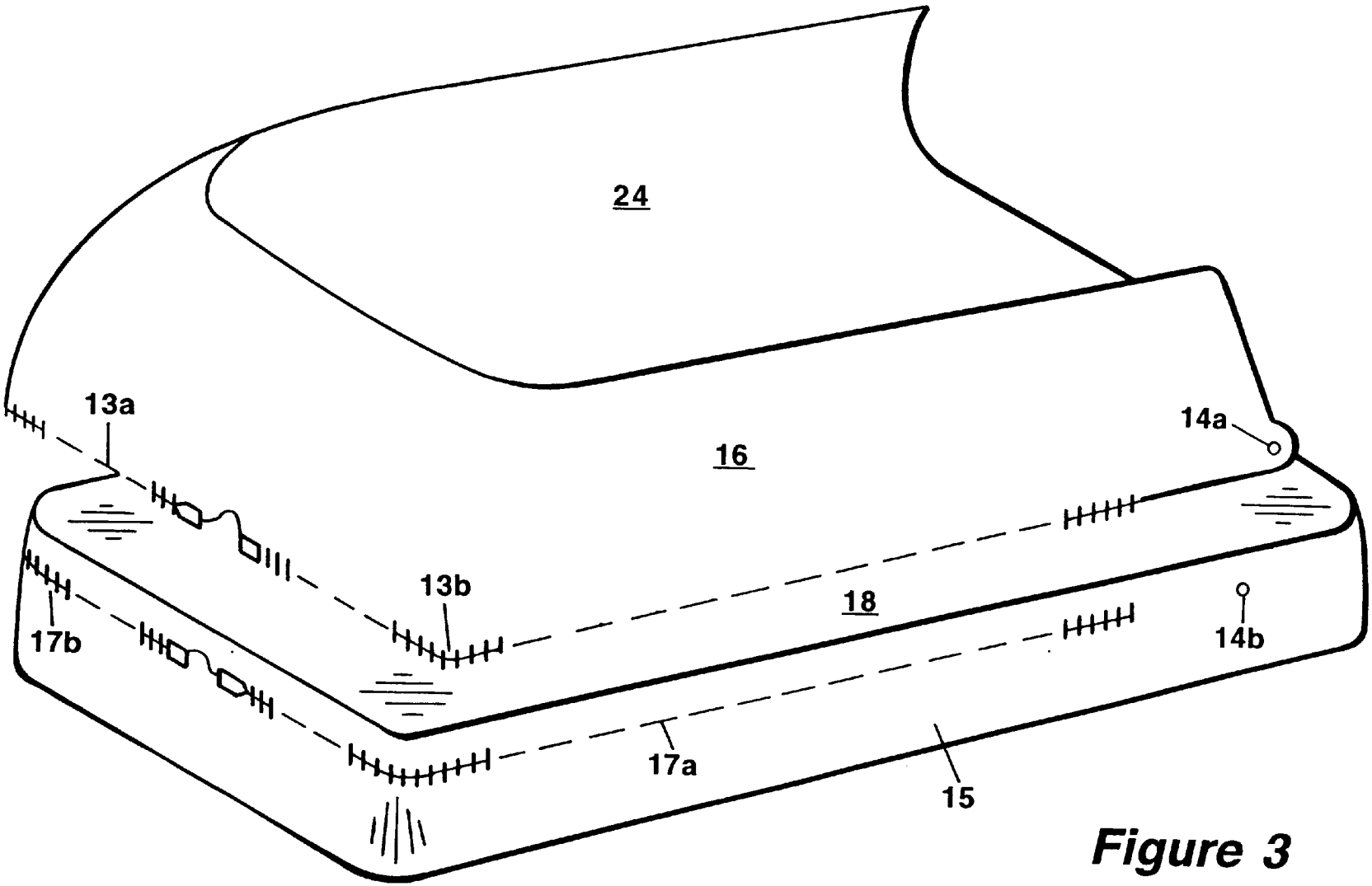
FIG. 3 is a perspective view of the invention shown with the top cover elevated above the mattress.

FIG. 3 is a depiction of the top cover elevated from the mattress 18 and the mattress band 15 that surrounds it. In this position the connection mechanism between the mattress band 15 and the top cover 24 becomes evident. The mattress band 15 has sewn into it two zipper portions 17*a,* 17*b.* Female zipper portion 17a is attached along a first section of the mattress band, and meshes with the male zipper portion 13*b* of the underlying extension 16 of the top cover 24. Similarly, male zipper portion 17*b* is attached along a second section of the mattress band that is opposite the first section, relative to an axis of symmetry passing through the center of the mattress 18 from head to foot. The male zipper portion 17*b* of the mattress band 15 meshes with the female zipper portion 13*a* of the underlying extension 16 of the top cover 24. Thus, the top cover 24 may be removably secured to the mattress band 15 on both sides of the bed.

When the zipper portions 13*a* and 17*b* are connected together, and the zipper portions 13*b* and 17*a* are connected together, the top cover will lay over the mattress, with its sides hanging down so as to obscure the underlying extension 16. Since the top cover is not tightly drawn over the top of the mattress 18, there is room between the top cover 24 and the mattress 18 for a person or persons to sleep. That is, with the top cover 24 secured to the mattress band 15 and covering the mattress as shown in FIG. 1, a person could climb between the top cover and mattress. When doing so, the excess top cover material draped over the sides of the mattress would be drawn up without any strain being placed on the zipper connections between the top cover and the mattress band. Nevertheless, the zipper connections remain in place to prevent the top cover being drawn completely off of a sleeper on the mattress.

Figure 4:
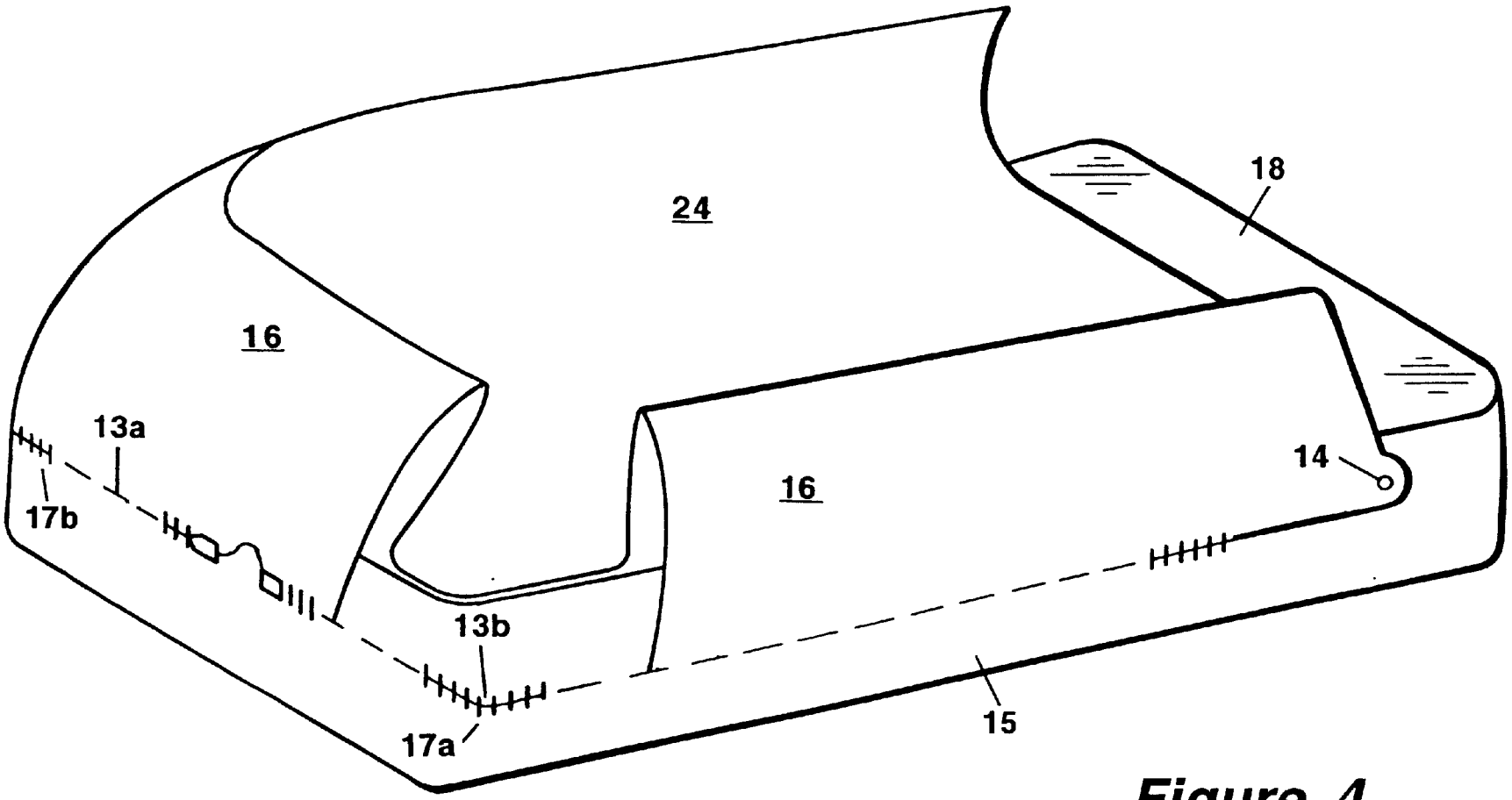
FIG. 4 is perspective view of the invention shown with the top cover secured to the mattress band and with the underlying extensions of the top cover elevated, and with a portion of the top cover cut away.
Figure 5:
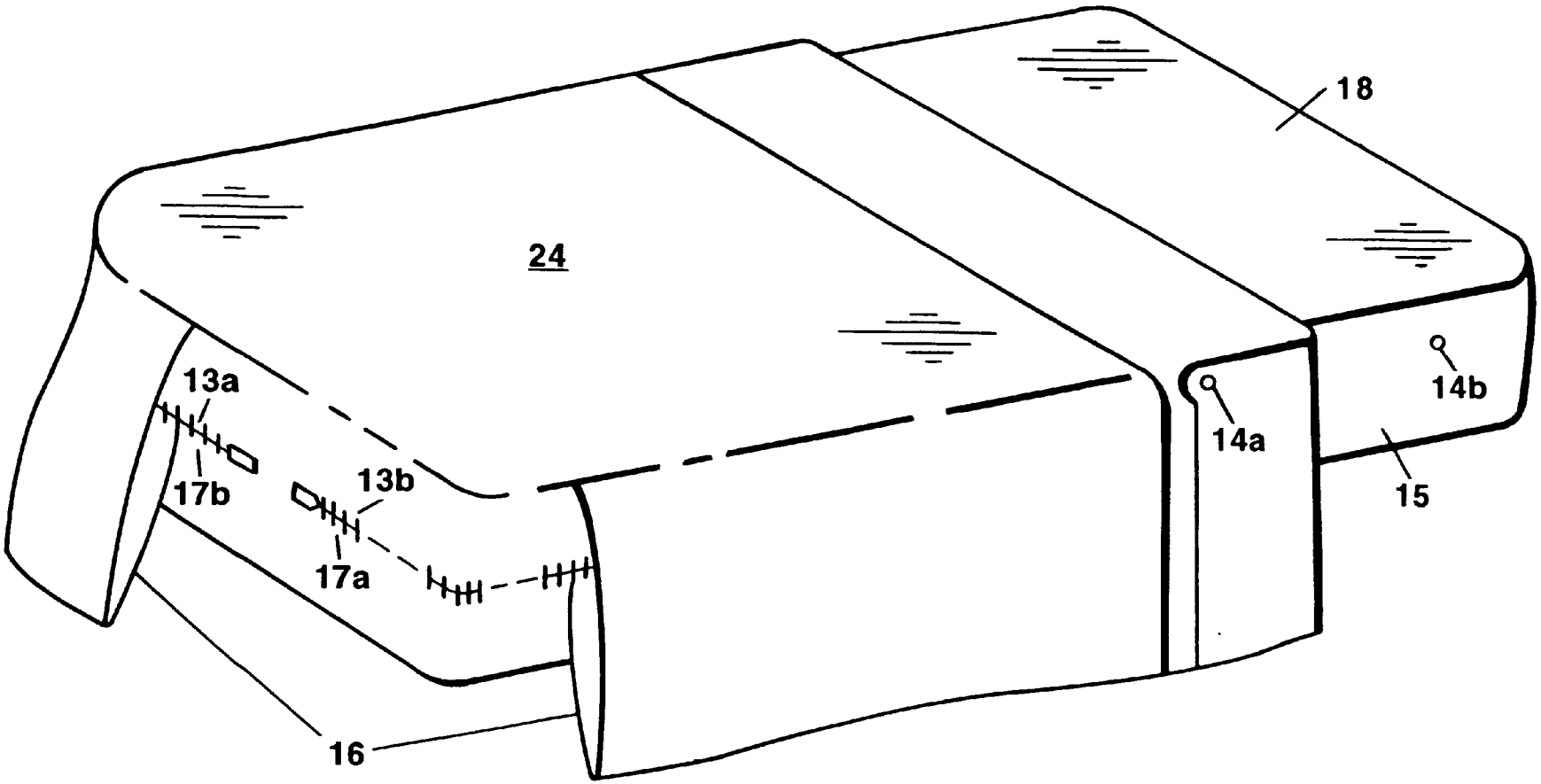
FIG. 5 is a perspective view of the invention similar to FIG. 1, but with a cutaway of the top cover showing the securing between the top cover and the mattress band.

The nature of the connections between the top cover and the mattress band 15 are well depicted in FIG. 4 and FIG. 5. In FIG. 4, the top cover is shown connected to the mattress band 15, but with the excess material drawn up that would usually hang down over the sides of the mattress. A portion of the material of the top cover 24 is also shown cut away to better depict this excess material. As shown in this figure, zipper portion 13*a* is connected to zipper portion 17*b,* and zipper portion 13*b* is connected to zipper portion 17*a.* Furthermore, the underlying extension 16 is visible, and the snap portions 14*a* and 14*b* are connected together, thereby restricting the corners of the top cover 24 near the head of the mattress to the mattress band.

In FIG. 5, the bedding is shown as in FIG. 1, but with a portion of the top cover again cut away. In this view, the top cover hangs down as it normally would when the bed was made. The zipper portions are connected as in FIG. 4, and the underlying extension 16 is obscured from view. Notably, in this view the portion of the top cover near the head of the bed is folded back, and snap 14*a* is therefore not connected to snap 14*b.*

Figure 6:
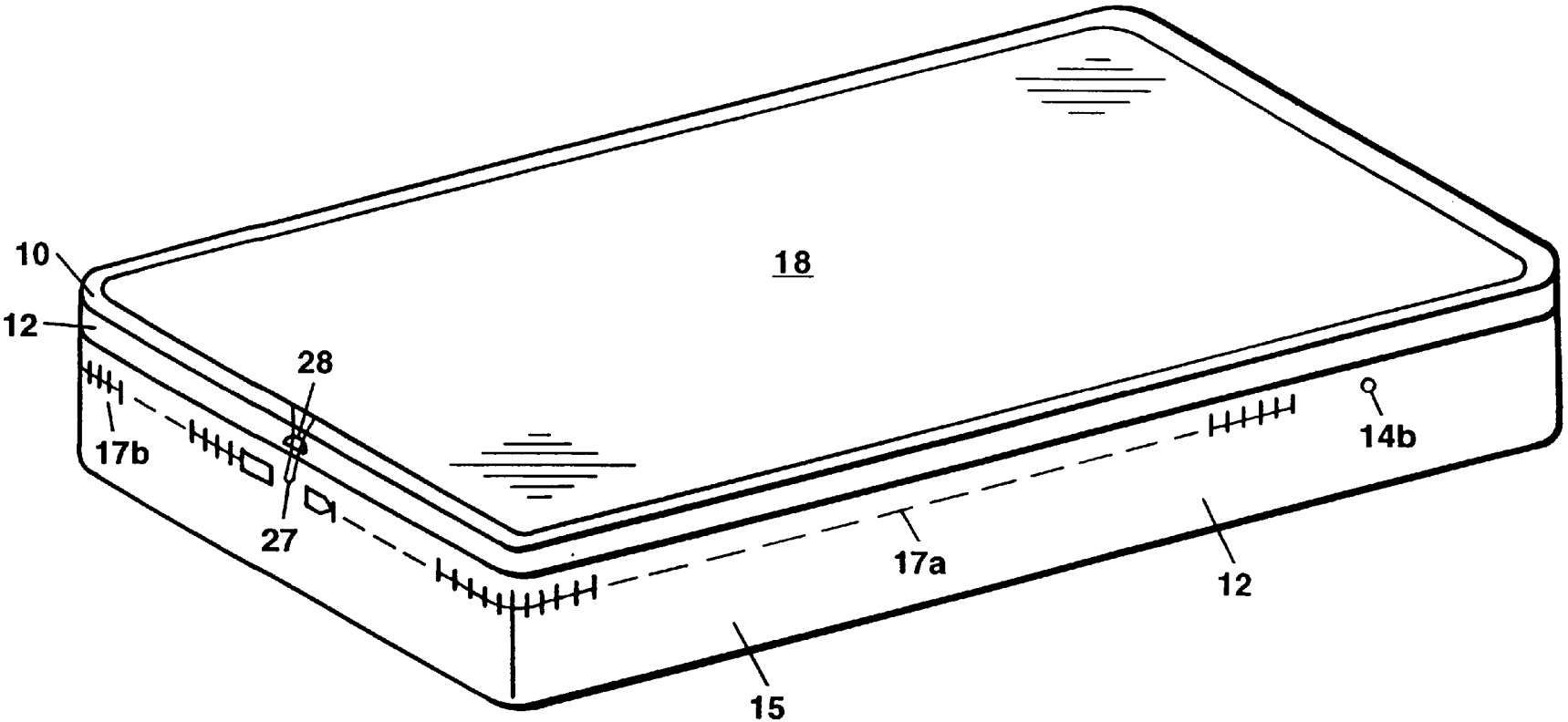
FIG. 6 is a top perspective view of the mattress band of the invention secured to a mattress.

One of the advantageous features of the present invention is the use of a removable mattress band on which to mount the zipper portions 17*a,* 17*b.* Because the mattress band is removable, the bedding may be used with a standard set of bed sheets. Shown in FIG. 6 is mattress 18 and mattress band 15, without the top cover. The mattress band 15 is made of a durable material that is tailored to the shape of the mattress. As shown, the mattress band wraps around the perimeter of the bed, and is held in place by some form of securing mechanism. In the preferred embodiment, the mattress band includes a drawstring 27 that resides within a channel that is sewn into its upper region. Tightening the drawstring causes the material surrounding the channel to be drawn inward on a top side of the mattress 18. The drawstring may then be secured using a standard releasable catch mechanism 28, causing the mattress band to be secured to the top of the mattress.

Figure 7:
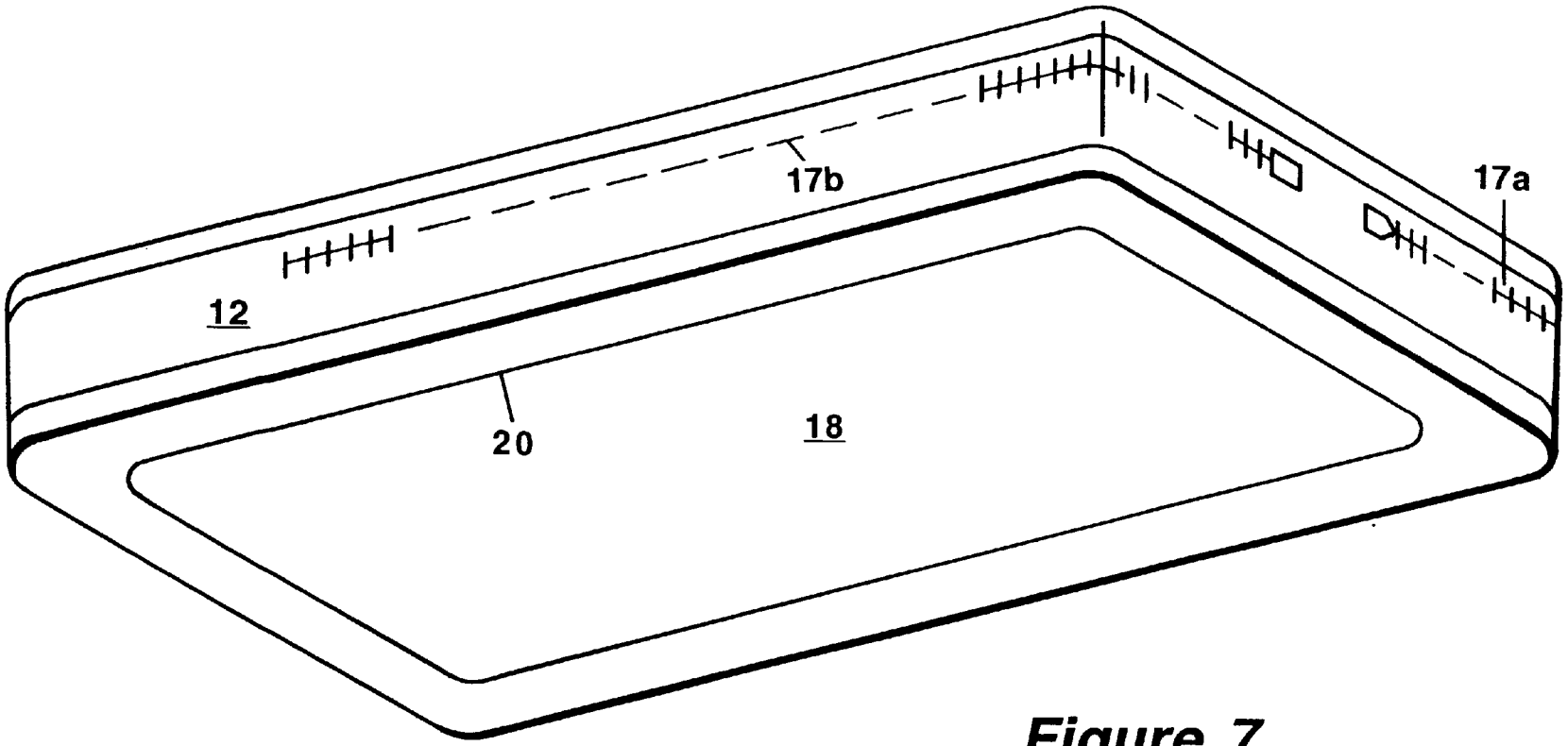
FIG. 7 is a bottom perspective view of the mattress band of the invention secured to a mattress.

To secure the lower side of the mattress band, the preferred embodiment uses a wide band elastic 20, as shown in the bottom perspective view of FIG. 7. This elastic causes material along the bottom portion of the mattress band 15 to be gathered inward along the bottom side of the mattress 18. This secures the mattress band to the bottom of the mattress. Thus, with its top and bottom portions held in place, the mattress band 15 provides a secure mount for zipper portions 17*a,* 17*b*. With the top cover 24 zipped to the mattress band, it is therefore held in place relative to the mattress. Notably, in the preferred embodiment, the mattress band material that is gathered along the top of the mattress, and the mattress band material that is gathered along the bottom side of the mattress is tailored so as to fit flat against the mattress surface. Thus, there is no bunching of the material when it is gathered inward.

A conventional fitted sheet may be located on the mattress under the mattress band. When the sheet is to be changed, the drawstring on the top of the mattress band is loosened, allowing access to the sheet underneath. The sheet on the bed is then removed, and a new sheet is placed on the mattress. When the new sheet is in place on the mattress, the drawstring of the mattress band is then tightened to secure it in place. The top cover 24 may then be zipped to the mattress band as described above.

Figure 8A:
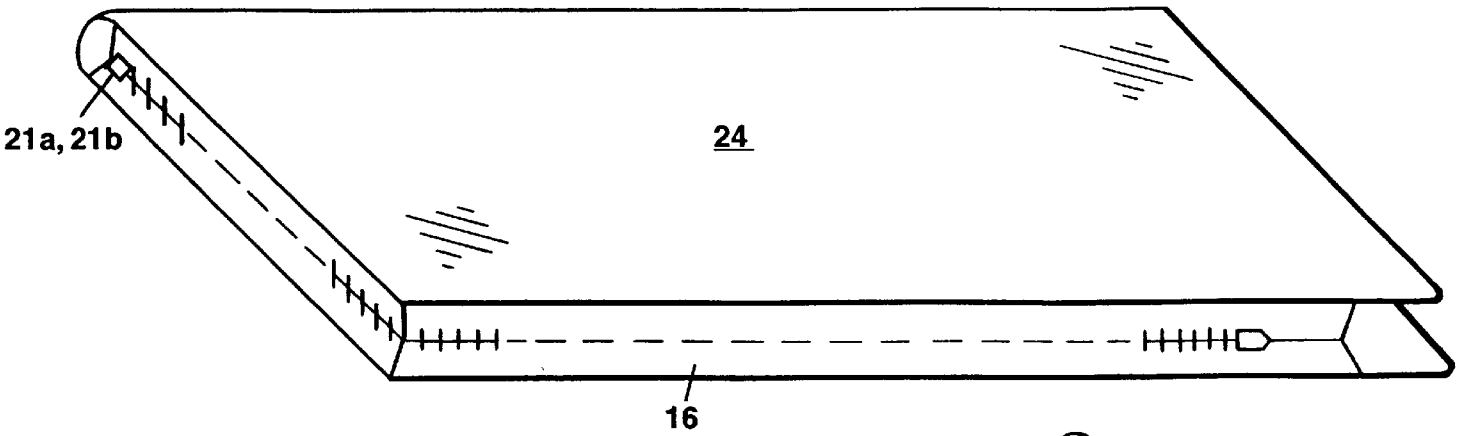
FIG. 8A is a perspective view of the top cover of the invention secured to itself as a self-contained sleeping enclosure.
Figure 8B:
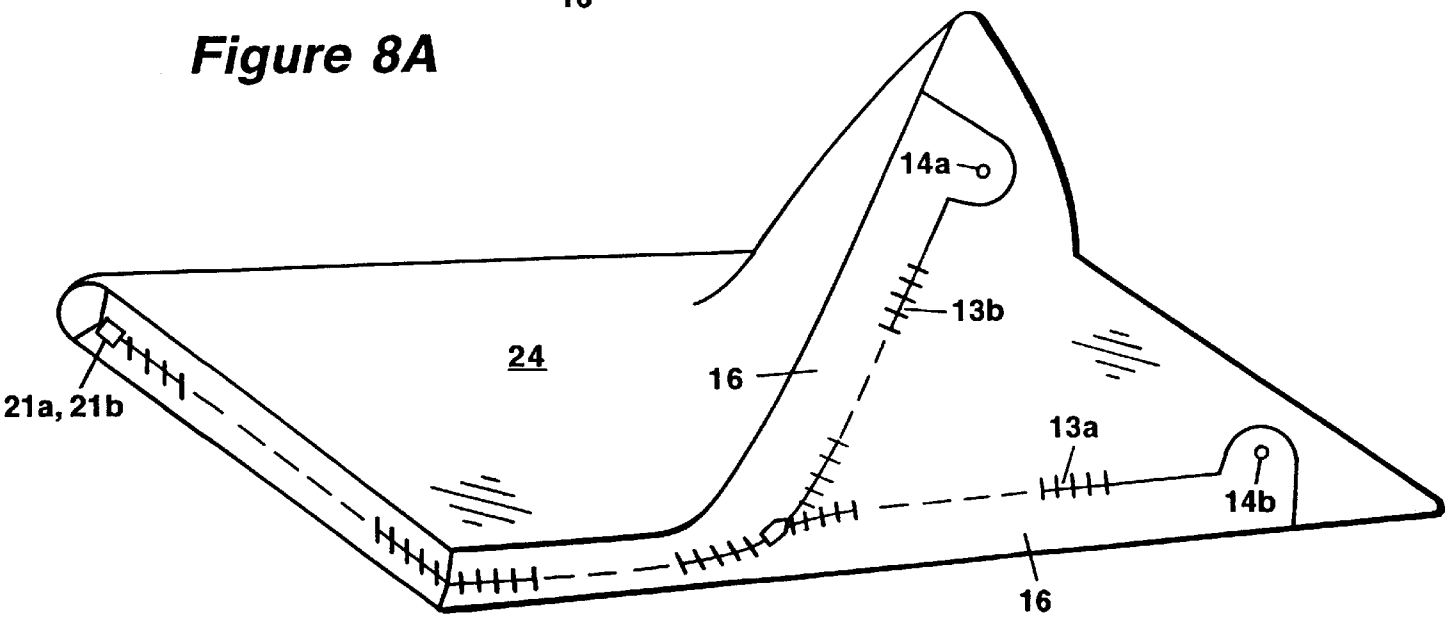
FIG. 8B is a perspective view of the top cover of the invention similar to FIG. 8A, but with the top cover only partially secured to itself.

In the preferred embodiment of the invention, the top cover 24 maybe removed from a bed, and used as a portable sleeping enclosure. Indeed, as shown in FIGS. 8A and 8B, the top cover functions essentially like a sleeping bag in this capacity. In FIG. 8A, the top cover 24 is shown in a closed position, the female and male zipper portions 13*a,* 13*b* of underlying extension 16 being zipped together so that the resulting enclosure is secured on substantially three sides. While the zipper portions do not reach all the way to the "head" end of the enclosure, this allows a person in the enclosure to turn down a top portion of the top cover 24 away from his or her face. Furthermore, female snap 14*a* and male snap 14*b* of the underlying extension 16 may be connected together to secure the two sides of the top cover 24 closer to the head of the enclosure. The location of these two snaps is better shown in FIG. 8B, which depicts the sleeping enclosure in a partially open state.

While the invention has been shown and described with reference to a preferred embodiment thereof, it will be recognized by those skilled in the art that various changes in form and detail may be made herein without departing from the spirit and scope of the invention as defined by the appended claims. For example, the zippers may be replaced with other connection elements, such as hook and pile cloth, buttons, snaps or the like.

What is claimed is:

1. A bedding apparatus comprising:

a mattress band that is removably securable to a mattress along at least two opposite sides of the mattress; and a top cover that is removably securable to the mattress band with first and second securing connections adjacent to said first and second opposite sides, respectively, the first securing connection having a vertical position higher than one to which the top cover hangs under the force of gravity along the first side when a space between the mattress and the top cover is unoccupied by a person such that a portion of the top cover is folded between an outer portion of the top cover and the mattress, a total length of the top cover between the securing connections being sufficient to allow a person to be accommodated in said space without significant strain on said securing connections, wherein the first securing connection comprises a first cooperating portion permanently attached to the top cover and the second securing connection comprises a second cooperating portion permanently attached to the top cover, and wherein the first cooperating portion is connectable to the second cooperating portion.

2. A bedding apparatus according to claim 1 wherein the securing connections comprise a zipper.

3. A bedding apparatus according to claim 2 wherein the first cooperating portion comprises a male zipper portion that is and the second cooperating portion comprises a female zipper portion.

4. A bedding apparatus according to claim 3 wherein, when the top cover is removed from the mattress band, the male zipper portion and the female zipper portion may be connected together to form a self-contained sleeping enclosure.

5. A bedding apparatus according to claim 3 wherein the first securing connection further comprises a connector closer to an unsecured end of the top cover than the securing connections, the connector including a connection portion on the mattress band and a connection portion on the top cover.

6. A bedding apparatus according to claim 1 wherein the mattress band comprises a closed loop that encircles the mattress when it is secured thereto.

7. A bedding apparatus according to claim 6 wherein the mattress band comprises an elastic portion that helps keep it secured to the mattress.

8. A bedding apparatus according to claim 6 wherein the mattress band comprises a drawstring that helps keep it secured to the mattress.

9. A bedding apparatus according to claim 1 wherein the mattress band is securable to the mattress without a physical connection to the mattress.

10. A bedding apparatus according to claim 1 wherein the mattress band is securable to the mattress over an underlying covering already in place on the mattress.

11. A bedding apparatus according to claim 1 wherein the folded portion of the top cover comprises a thinner material than a portion of the top cover that lies atop the mattress.

12. A bedding apparatus according to claim 1 wherein the securing connections allow connection of the top cover to the mattress band along three sides of the mattress.

13. A bedding apparatus comprising:

a mattress band that is removably securable to a mattress along at least three sides of the mattress including two opposite sides, the securing being without a physical connection to the mattress, the mattress band being securable to the mattress over an underlying covering already in place on the mattress; and a top cover that is removably securable to the mattress band along said three sides with first and second securing connections adjacent, respectively, to said two opposite sides, each securing connection having a vertical position higher than one to which the top cover hangs under the force of gravity when a space between the mattress and the top cover is unoccupied by a person, such that a portion of the top cover is folded between an outer portion of the top cover and the mattress along each of the opposite sides, a total length of the top cover between the securing connections being sufficient to allow a person to be accommodated in said space without significant strain on said securing connections, wherein the first securing connection comprises a first cooperating portion permanently attached to the top cover and the second securing connection comprises a second cooperating portion permanently attached to the top cover, and wherein the first cooperating portion is connectable to the second cooperating portion.

14. A method of providing an insulating cover to a sleeping person lying on a mattress, the method comprising:

removably securing a mattress band to the mattress along at least two opposite sides of the mattress; and removably securing a top cover to the mattress band with first and second securing connections adjacent to said first and second opposite sides, respectively, the first securing connection having a vertical position higher than one to which the top cover hangs under the force of gravity along the first side when a space between the mattress and the top cover is unoccupied by a person such that a portion of the top cover is folded between an outer portion of the top cover and the mattress, a total length of the top cover between the securing connections being sufficient to allow a person to be accommodated in said space without significant strain on said securing connections, wherein the first securing connection comprises a first cooperating portion permanently attached to the top cover and the second securing connection comprises a second cooperating portion permanently attached to the top cover, and wherein the first cooperating portion is connectable to the second cooperating portion.

15. A method according to claim 14 wherein securing the top cover to the mattress band comprises securing the top cover to the mattress band with a zipper.

16. A method according to claim 14 wherein the first cooperating portion comprises a male zipper portion and the second cooperating portion comprises a female zipper portion that is permanently attached to the top cover.

17. A method according to claim 16 further comprising using the top cover as a self-contained sleeping enclosure when it is away from the mattress by connecting the male zipper portion and the female zipper portion to each other.

18. A method according to claim 14 wherein the mattress band comprises a closed loop that encircles the mattress when it is secured thereto.

19. A method according to claim 14 wherein the mattress band is securable to the mattress over an underlying covering already in place on the mattress.

20. A method according to claim 14 wherein securing the top cover to the mattress band comprises securing the top cover to the mattress band along three sides of the mattress.

* * * * *